US006422694B1

(12) United States Patent
Hollands

(10) Patent No.: US 6,422,694 B1
(45) Date of Patent: Jul. 23, 2002

(54) METHOD AND SYSTEMS FOR SUPPLYING HOT MELT INK TO A PRINTER

(75) Inventor: Peter Joseph Hollands, Baarlo (NL)

(73) Assignee: Oce Technologies B.V., Venlo (NL)

( * ) Notice: Subject to any disclaimer, the term of this patent is extended or adjusted under 35 U.S.C. 154(b) by 0 days.

(21) Appl. No.: 09/716,248

(22) Filed: Nov. 21, 2000

(30) Foreign Application Priority Data

Nov. 22, 1999 (EP) ..... 99203944
Feb. 4, 2000 (EP) ..... 00200361

(51) Int. Cl.[7] ..... B41J 2/175
(52) U.S. Cl. ..... 347/88; 347/85
(58) Field of Search ..... 347/85, 86, 87, 347/88; 206/497

(56) References Cited

U.S. PATENT DOCUMENTS 4,636,803 A 1/1987 Mikalsen ..... 347/88
4,667,206 A 5/1987 DeYoung ..... 347/88
4,723,135 A * 2/1988 Yano et al. ..... 347/88
4,823,146 A * 4/1989 Cooke et al. ..... 347/88
4,864,330 A 9/1989 Creagh et al. ..... 347/88
5,621,444 A 4/1997 Beeson ..... 347/88
5,630,510 A * 5/1997 Lamb, Jr. et al. ..... 206/497

FOREIGN PATENT DOCUMENTS

EP 338590 A2 10/1989
EP 3340533 11/1989
EP 827835 A2 11/1998

OTHER PUBLICATIONS

Patent Abstracts of Japan, vol. 14, No. 331 (M0999), Jul. 17, 1990 & JP 02–113951A (Seiko Epson Corp.), Apr. 26, 1990.
Patent Abstracts of Japan, vol. 009, No. 297 (M–432), Nov. 25, 1985 & JP 60–135260 A (Nippon Denshin Denwa Kosha), Jul. 18, 1985.

* cited by examiner

*Primary Examiner*—Anh T. N. Vo
(74) *Attorney, Agent, or Firm*—Birch, Stewart, Kolasch & Birch, LLP

(57) ABSTRACT

A method for supplying pellets of hot melt ink to a printer using an ink reservoir having an inlet port, which comprises sequentially supplying the ink pellets to the ink reservoir through the inlet port whereby when the ink pellet is positioned in the inlet port it serves as a closure member for the reservoir and when the ink pellet is introduced into the ink reservoir it is replaced with a new ink pellet which serves as a new closure member.

10 Claims, 2 Drawing Sheets

METHOD AND SYSTEMS FOR SUPPLYING HOT MELT INK TO A PRINTER

BACKGROUND OF THE INVENTION

The present invention relates to a method and a supply system for supplying pellets of hot melt ink to a printer comprising an ink reservoir having an inlet port through which the ink pellets are supplied, and a closure member for sealingly closing the inlet port.

Ink jet printers operating with hot melt ink, i.e. with ink that is solid at room temperature, comprise an ink reservoir which can be heated in order to melt the ink and to keep it in the liquid state so that it can be supplied to the printhead. The ink can be supplied to this ink reservoir in the form of pellets which are then melted in the ink reservoir.

If the inlet port of the ink reservoir is left open while the printer is operating, a vapor of melted and evaporated ink could escape from the ink reservoir, whereby the other components of the printer would become soiled with condensated ink. It is therefore desirable to provide a closure member for sealingly closing the inlet port. This, however, has the consequence that the process of introducing ink pellets into the ink reservoir becomes more complicated and the more difficult to automate, because it is necessary to remove and to re-install the closure member each time an ink pellet is added to the ink reservoir.

EP-A-0 340 533 discloses a refill cartridge for hot melt ink in which a pellet of solidified ink is contained in a hood-shaped envelope which can be placed onto the inlet port of the ink reservoir with the open side facing downward. Then, by deforming the walls of the envelope, the ink pellet can be pressed out so that it can be dropped into the ink reservoir.

U.S. Pat. No. 4 864 330 discloses a refill cartridge in which a pellet of hot melt ink is connected to a handle. In this case, the pellet is held with the handle and placed into the inlet port of the ink reservoir. Since the pellet is held non-rotatably in this inlet port by a key structure, the handle can be broken away by turning the same, so that the pellet alone drops into the ink reservoir.

Although the ink pellets disclosed in these documents are temporarily held in the inlet port of the ink reservoir, there still remains the necessity to provide a closure member for sealing the inlet port during the time periods in which the printer is operating and no new pellet is added.

SUMMARY OF THE INVENTION

It is an object of the present invention to provide a method and a supply system for supplying pellets of hot melt ink to the printer in which the process of opening the inlet port of the ink reservoir, passing the ink pellet therethrough and re-sealing the inlet port is facilitated.

According to the present invention, this object is achieved by a method in which one of the ink pellets is fitted in the inlet port so as to serve as said closure member, and, when this pellet is to be supplied to the ink reservoir, it is pressed through the inlet port and a new pellet replaces it as a new closure member.

Correspondingly, the ink supply system according to the present invention is characterized in that the closure member consists of an ink pellet held in the inlet port by friction, but eventually pushed through into the ink reservoir to be replaced by a new closure member.

Thus, when a new ink pellet is to be supplied into the ink reservoir, it is sufficient to handle the ink pellets themselves, and there is no necessity to utilize separate structures as closure members.

Advantageously, the inlet port is defined by a flexible membrane which can be reversibly deformed when an ink pellet is pressed there through. Depending on the size and configuration of the ink reservoir, the ink pellet held in fitting engagement in the inlet port will be subject to the heat of the melted ink in the ink reservoir to a greater or lesser extent. In a preferred embodiment the inlet port should therefore be thermally insulated from or shielded against the melted ink and/or the heating system of the ink reservoir at least to such an extent that the ink pellet serving as the plug for closing the inlet port will not be melted and become dislodged before it is pressed into the ink reservoir and replaced by a new pellet. To this end, a heat shield may be provided inside of the ink reservoir, and/or a sufficient distance may be provided between the inlet port and the space accommodating the melted ink. If the walls of the ink reservoir are made of a material having a high heat conductivity for heating the ink or achieving an even temperature distribution, then the wall portions of the heat reservoir defining the inlet port may be made from a different material having a smaller heat conductivity.

BRIEF DESCRIPTION OF THE DRAWINGS

Preferred embodiments of the present invention will now be described in conjunction with the drawings, in which.

DETAILED DESCRIPTION OF THE INVENTION

Figure 1:
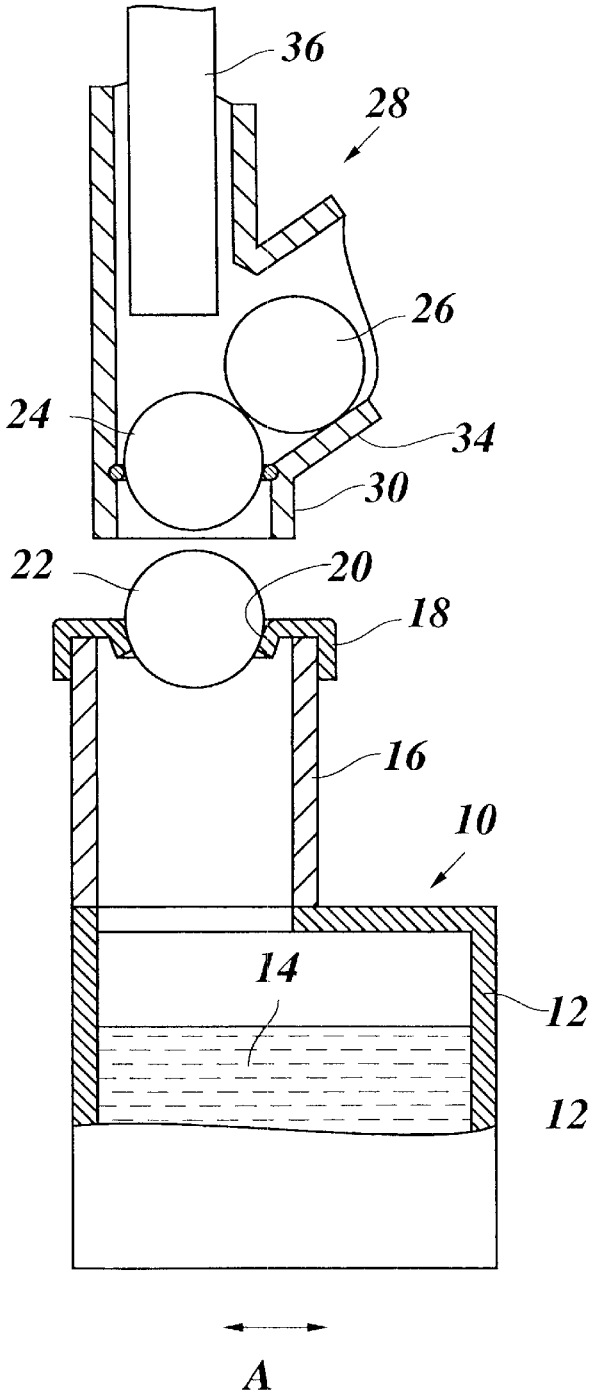
FIG. 1 is a cross-sectional view of the essential parts of an ink supply system of an ink jet printer.

FIG. 1 illustrates an ink reservoir 10 having walls 12 made of a thermally conductive material. As is generally known in the art, electric heating means (not shown) are in contact with or integrated in the walls 12 of the ink reservoir so that hot melt ink 14 contained in the ink reservoir is kept at a temperature of, for example, 120° C. or in any case at a temperature above its melting point, so that the ink is kept in the liquid state and is ready to be supplied to an ink jet printhead (not shown) which is in fluid connection with the ink reservoir. As is also generally known in the art, the ink reservoir 10 and the printhead may be mounted on a reciprocating carriage of the printer, so that the ink reservoir 10 is moved back and forth in the direction of a double arrow A in FIG. 1 when the printer is operating.

The top side of the ink reservoir 10 has a tubular projection 16 the walls of which are made of a material which has a relatively small heat conductivity. A flexible membrane 18 is permanently fitted to the top end of the tubular projection 16 and defines a circular central opening which serves as an inlet port 20 for globular ink pellets 22, 24, 26 which consist of solidified hot melt ink which is supplied to the interior of the ink reservoir 10 on demand. As is shown in FIG. 1, the inlet port 20 is sealingly closed by an ink pellet 22 which is fitted into the opening of the membrane 18 like a plug and is held in position by frictional forces, with a slight elastic deformation of the portions of the membrane 18 defining the edge of the inlet port.

The length and the material of the tubular extension 16 assures a sufficient thermal insulation between the pellet 22 and the heated walls 12 and the melted ink 14, even when the level of the melted ink 14 in the ink reservoir 10 is close to its maximum level. Thus, the ink forming the plug 22 will not melt, and the pellet will not become dislodged, so that the inlet port 20 will remain permanently sealed. Thus, the ink pellet 22 serves as a closure member which prevents vapors of melted ink from escaping out of the ink reservoir. Of course, this closure member also prevents dust and other contaminants from entering into the ink reservoir.

In the shown embodiment, a dispenser 28 for ink pellets is disposed above the path of travel of the ink reservoir 10 mounted on the reciprocating carriage. The dispenser 28 is held stationary in a position which is aligned with the tubular extension 16 of the ink reservoir 10 when the carriage stops in a predetermined home position. The dispenser 28 may be of any known construction suitable for dispensing ink pellets 24, 26 one-by-one. In the example shown, the dispenser forms a chute 30 for safely guiding the pellet being dispensed to the inlet port 20 of the ink reservoir. An elastic ring 32 is disposed inside of the chute 30 for frictionally holding the lowermost pellet 24 in position. The other pellets are supplied to the chute 30 via an inclined ramp 34, as is shown for the pellet 26 in FIG. 1. This pellet 26 abuts the pellet 24 in a position laterally offset from the chute 30. Thus a pusher 36, which is reciprocally disposed above the chute 30, is positioned to move downward past the pellet 26 and to engage the top side of the pellet 24 held in the chute.

Figure 3:
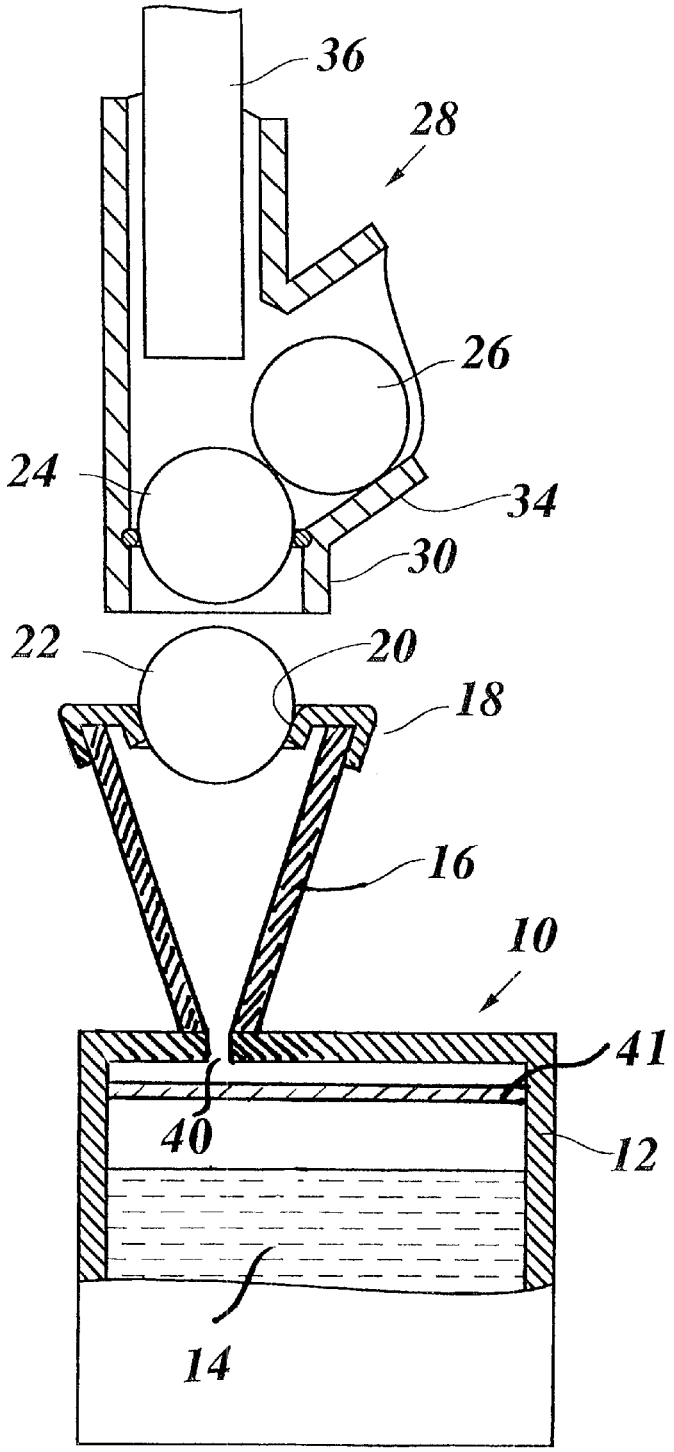
FIG. 3 is a cross-sectional view of the essential parts of an ink supply system according to another embodiment of the present invention.

FIG. 3 illustrates a second embodiment of the ink supply system according to the present invention. In this embodiment the projection 16 is formed into a so called pre-melt chamber, composed of oblique and thermally conductive walls. The flexible membrane 18 is fitted to the top end of this pre-melt chamber.

In this embodiment the oblique walls are thermally connected with walls 12, which has the advantage that no additional heating means for heating the oblique walls have to be present. When an ink pellet is fed into the ink reservoir via inlet port 20 it becomes engaged with the heated walls of projection 16 and melts. The melted ink flows along the oblique walls and enters the cavity surrounded by walls 12 via a small opening 40. From here, the fluid ink passes filter 41 and joins the liquid ink supply 14 held in the reservoir. In this embodiment the inlet port is also shielded from the melted ink and in paticular against ink vapor originating from the liquid ink supply. Thus, the ink pellet serving as a plug for closing the inlet port will not be melted and become dislodged before it is pressed into the ink reservoir and replaced by a new pellet.

Figure 2:
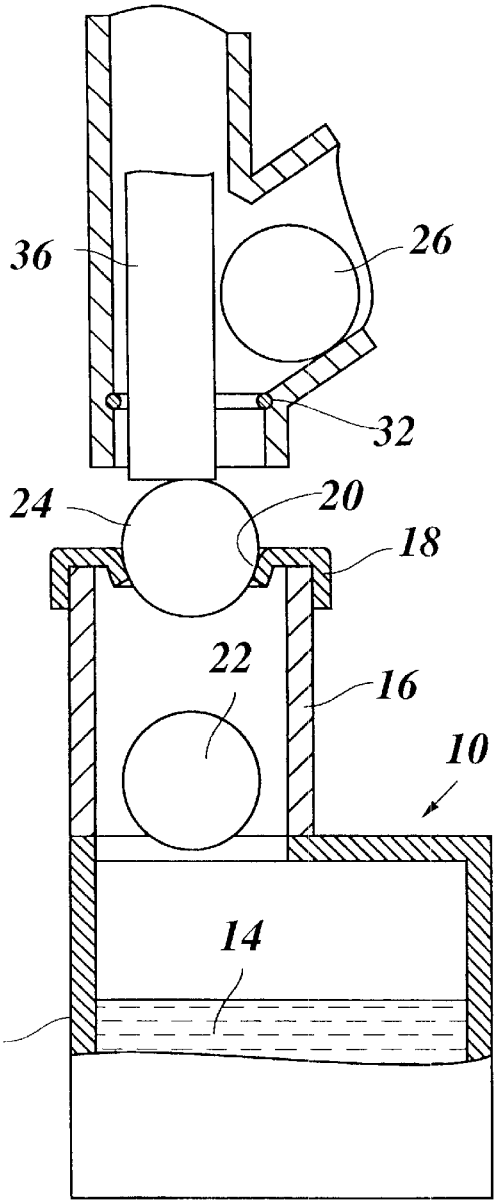
FIG. 2 is a view corresponding to FIG. 1 but showing the ink supply system in a different state.

When the printer has been operating for some time and a certain amount of liquid ink in the ink reservoir 10 has been consumed, it is necessary to supply another ink pellet into the ink reservoir 10 so that it may be heated and melted in order to increase the amount of liquid ink available in the ink reservoir. Thus, the next time the carriage temporarily stops at its home position, the pusher 36 is moved downward, as is shown in FIG. 2. The lower end of the pusher 36 engages the pellet and presses the same through the ring 32, so that the pellet 24 falls onto the pellet 22 while still being guided in the chute 30. When the pusher 36 continues to move downward, the pellet 24 presses the lower pellet 22 deeper into the inlet port 20, so that the membrane 18 is elastically deformed. Finally, the pellet 22 is pressed through the inlet port 20 in its entirety and drops into the interior of the ink reservoir, while the configuration of the elastic membrane 18 is restored and the inlet port 20 regains its pellet restraining position. Thus, the pellet 24 is caught by the membrane 18 and is then pressed into the inlet port by the pusher 36. The lower extreme position of the pusher 36 is set to assure that the pellet 24 is neither pushed through the membrane 18 nor repelled upward by the membrane but is firmly held in the inlet port 20 so as to serve as the new closure member.

When the pusher 36 is moved upward into the position shown in FIG. 1, the next pellet 26 engages the ring 32 of the chute 30, so that a new supply cycle may be started on demand.

It will be appreciated that the process of supplying a single pellet to the ink reservoir 10 as described above can be accomplished within a very short time, without causing any substantial delay in the printing operation. As a result, it is not necessary to use ink pellets having a large volume in order to increase the intervals between the supply cycles. Since the pellets supplied into the ink reservoir have to be melted therein, a reduced volume of the ink pellets has the advantage that the fluctuation in the temperature and hence in the viscosity of the melted ink is greatly reduced, so that a uniform quality of the printed image can be achieved.

What is claimed is:

1. A method for supplying pellets of hot melt ink to a printer using an ink reservoir for holding melted ink and having an inlet port, which comprises sequentially supplying the ink pellets to the ink reservoir through the inlet port whereby when the ink pellet is positioned in the inlet port it serves as a closure member for sealingly closing the reservoir and when the ink pellet is introduced into the ink reservoir it is replaced with a new ink pellet which serves as a new closure member for sealingly closing the reservoir.

2. The method of claim 1, wherein the ink pellet is forcefully introduced into the ink reservoir by the new closure member.

3. An apparatus for supplying ink pellets to a printer which comprises an ink reservoir for holding melted ink and having an inlet port through which ink pellets are supplied, said inlet port providing engagement with said ink pellets, whereby said ink pellets function in turn as closure members for sealingly closing the inlet port to the ink reservoir.

4. The apparatus of claim 3, wherein the inlet port is formed by a reversibly deformable member.

5. The apparatus of claim 4, wherein the reversibly deformable member is an elastic membrane.

6. The apparatus of claim 3, wherein an ink pellet dispenser is disposed to be in alignment with the inlet port.

7. The apparatus of claim 6, wherein the ink pellet dispenser is provided with a supply of ink pellets and a pusher for pushing a new ink pellet against the ink pellet acting as the closure member.

8. The apparatus of claim 7, wherein said new ink pellet is held in position by an elastic ring.

9. The apparatus of claim 3, wherein the inlet port is thermally shielded from the ink reservoir by a tubular, insulated projection.

10. The apparatus of claim 3, wherein the inlet port is shielded from the ink reservoir by a cone shaped projection having its apex facing the ink reservoir.

* * * * *